US006398642B1

(12) United States Patent
Kim

(10) Patent No.: US 6,398,642 B1
(45) Date of Patent: Jun. 4, 2002

(54) MAHJONG GAME MACHINE

(76) Inventor: Tai-Up Kim, Family Apt. 205-1302, Moonjung-dong 150, Songpa-gu, Seoul (KR), 138-768

( * ) Notice: Subject to any disclaimer, the term of this patent is extended or adjusted under 35 U.S.C. 154(b) by 0 days.

(21) Appl. No.: 09/599,639

(22) Filed: Jun. 23, 2000

(30) Foreign Application Priority Data

Jun. 23, 1999 (KR) ..... 1999-23627

(51) Int. Cl.[7] ..... A63F 9/24
(52) U.S. Cl. ..... 463/11; 463/46; 273/237
(58) Field of Search ..... 463/1, 9–13, 16, 463/25, 29, 30, 36; 273/292–293, 309, 308, 138.2, 139, 306, 299, 236, 237; 700/91–93

(56) References Cited

U.S. PATENT DOCUMENTS 5,938,528 A * 8/1999 Glapion ..... 273/309

FOREIGN PATENT DOCUMENTS

| | | | | |
|---|---|---|---|---|
| JP | 1-313080 | * | 12/1989 | |
| JP | 2-077283 | * | 3/1990 | |
| JP | 7-008629 | * | 1/1995 | |
| JP | 7-236768 | * | 9/1995 | |
| JP | 8-206362 | * | 8/1996 | |
| JP | 8-243258 | | 9/1996 | ..... A63F/9/22 |
| JP | 10-000274 | * | 1/1998 | |
| JP | 10-17993 | * | 7/1998 | |

* cited by examiner

*Primary Examiner*—Mark Sager
(74) *Attorney, Agent, or Firm*—Jacobson Holman, PLLC

(57) ABSTRACT

A Mahjong game machine has a body and four player pads. The body includes a microprocessor for executing a Mahjong program and a main display for displaying a series of contents associated with the progress of the game. Each player pad has a L-shaped section, and thus consists of a vertical portion and a horizontal portion. Said vertical portion of each player pad has a hand display for displaying tiles in the hand of each player in such a manner that those tiles are not exposed to the other players, and a menu display section for sequentially displaying a menu for corresponding actions that the player should perform. Said horizontal portion of each player pad has a button section for inputting an action corresponding to the menu displayed on said menu display section.

4 Claims, 6 Drawing Sheets

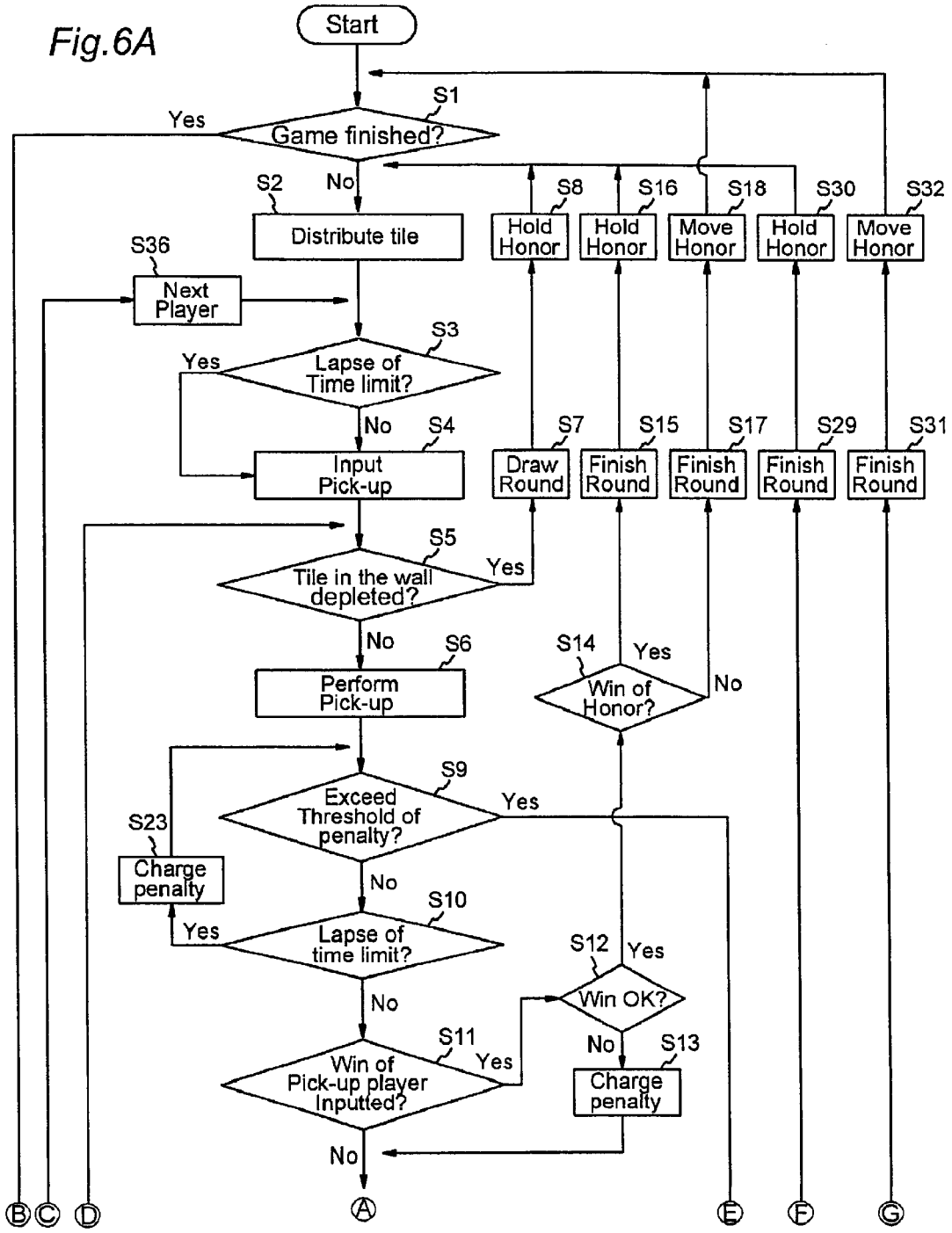
Fig.6A
Start
S1
Game finished?
Yes
No
S2
Distribute tile
S36
Next Player
S3
Lapse of Time limit?
Yes
No
S4
Input Pick-up
S5
Tile in the wall depleted?
Yes
No
S6
Perform Pick-up
S9
Exceed Threshold of penalty?
Yes
No
S23
Charge penalty
S10
Lapse of time limit?
Yes
No
S11
Win of Pick-up player Inputted?
Yes
No
S12
Win OK?
Yes
No
S13
Charge penalty
S14
Win of Honor?
Yes
No
S7
Draw Round
S8
Hold Honor
S15
Finish Round
S16
Hold Honor
S17
Finish Round
S18
Move Honor
S29
Finish Round
S30
Hold Honor
S31
Finish Round
S32
Move Honor
B
C
D
A
E
F
G

MAHJONG GAME MACHINE

BACKGROUND OF THE INVENTION

This invention relates to a game machine, and more particularly to a Mahjong game machine.

Mahjong is a classic game that has its origin in China and has been widely spread to more than 300 million people over the world including China, Japan, Taiwan, Hong Kong, Korea, the United States of America, Europe, etc. A Mahjong set includes a set of tiles, a pair of dice for deciding seats of players, a quantity of sticks used for scorekeeping, and a table used to keep the tiles upright and to keep their faces hidden from other players.

In general, Mahjong is a game in which four players compete to win by completion a valuable hand by picking up a tile from the wall and performing one of the post-pick-up actions (WIN, KONG, REACH, DISCARD), and performing one of the response actions (WIN, PONG, KONG, CHEE) for a tile discarded by other player. The essence of playing Mahjong is to complete a player's hand as soon as possible by making a series of good actions (decisions).

However, in the real Mahjong game, it is accompanied with processes requiring excessive time and labor such as the processes of mixing, distributing, and arranging tiles, and a process of calculating scores, etc., in addition to the essential activities.

Although the Mahjong game is becoming increasingly wide-spread as a tool for leisure as well as one of mind exercise due to its unique amusement and depth, such annoying processes have become significant factors discouraging the general public from learning the Mahjong game, and give an inconvenience to the Mahjong expert. Furthermore, in an actual Mahjong game, conduct unbecoming to a gentleman such as a pre-picking up of tiles, a substituting of tiles etc., may often cause troubles among players.

Considering these characteristics of the Mahjong game, a mechanized Mahjong table, which enables the mixing of tiles and building of a wall mechanically to eliminate an inconvenience of having to mix the tiles and build the wall from the tiles, has been developed. In addition, Mahjong is also programmed partly owing to the development of a variety of computer games so that it becomes possible to play the Mahjong game of an elementary level through video game machines or personal computers.

However, although the above mentioned mechanized Mahjong table can resolve the inconvenience of having to mix the tiles and build the wall, still a process of distributing and arranging the tiles, and a complex scoring process must be performed. Therefore the Mahjong game using the mechanized Mahjong table has limitations in that it is accompanied with processes requiring time and labor, and still may cause troubles due to the conduct unbecoming to a gentleman during the play of the Mahjong game.

Further, for the latter Mahjong computer program, a level of intelligence is very low, and there is no concept of controlling the time for each play of the game. Consequently, it cannot implement an actual play of the game among players, thereby not attracting an interest from Mahjong lovers.

Although a traditional Mahjong game does not stipulate clearly the time required for a player to perform each play of the game, basically a player is urged to perform a corresponding action without a delay of time. In fact, the game of Mahjong practically progresses in such a manner.

Therefore, other players always reproach a player who delays a progress of the game severely for the delay. It should be noticed that the China Mahjong game rule published (July, 1998) by the China National Sports Bureau stipulates time limits for each play of the game.

However, there is no such time controlling concept in a conventional Mahjong game for use in personal computers and video game machines. That is, the conventional computer Mahjong game allows a human player to perform an act without any time limit after the pick-up of a tile. In the mean time, it does not provide the human player with the time for determining whether or not to perform a response act (for example, WIN, PONG, KONG, CHEE) for a tile discarded by any other player. Instead, the microprocessor (computer) determines that the human player may perform one of the response acts, and thus stops the progress of the game to prompt the human player to perform an act. Once the game is stopped, the human player can delay time without limit.

In other words, the conventional computer Mahjong game does not control the times required for the human player to perform each play of the game. Also, although decision on whether or not to perform a response act is a critical decision which the human player should make himself, the conventional computer Mahjong game does not give the time required for the human player to determine whether or not to perform a response act. This never occurs in an actual Mahjong game, but all the conventional computer Mahjong games employ such a method, which results in the implementation of a very impractical Mahjong game. Therefore, it is clear that the conventional computer Mahjong game functions as only for amusement, and cannot realize a game for an actual contest.

Accordingly, the present inventor had developed an artificial intelligent computer Mahjong game by which all the rules and options of the Mahjong different by regions can be designated, by which the time required for a player to perform each play of the game can be set and controlled, by which levels for the cyber (computer) players can be selected diversely and freely from the first grade for beginners to the ninth grade equal to a level of world Mahjong champion, by which an actual Mahjong game can be implemented very realistically, and which can be installed and used in conventional personal computers and video game machines.

However, since the intelligent Mahjong game developed by the present inventor is basically operated through personal computers or video game machines, it has a limitation in that it cannot realize a traditional Mahjong game which four players play face-to-face.

An example of a Mahjong game machine is the Japanese patent laid open publication No. Heisei 8-243258 (published on Sep. 24, 1996) disclosing a game machine using a TV screen. The game machine of the Japanese patent publication is a TV game machine including a game machine body, four first display devices (pads for the TV game machine) adapted to display tiles in the hand and having buttons, and a second display device or TV CRT connected to the game machine body.

For the TV game machine, players are positioned apart from each other in front of a TV set so that tiles in their hands are not exposed to other players, and play the game watching the TV screen (CRT) with the first display device being held in their hands. Therefore the TV game machine can only be a game machine for amusements, differing greatly from a traditional Mahjong game in which four players who sit face-to-face with each other in four directions of the table perform a play viewing down tiles in their hands and tiles discarded by any other players.

Therefore, the present inventor has studied a Mahjong game machine which is easy to carry, in which annoying processes consuming time and labor such as processes of mixing, distributing and arranging tiles, and a process of calculating scores are performed automatically, in which the time required for a player to perform each play of the game is set and controlled, in which conducts unbecoming to a gentleman are basically prevented, and thus players can concentrate on the decision-makings while realizing the substantially same situation as in the traditional Mahjong game.

SUMMARY OF THE INVENTION

The primary object of the present invention is to provide a Mahjong game machine by which a player can play conveniently and efficiently the Mahjong game in the same manner as a traditional Mahjong game thereby enabling a realistic Mahjong contest.

Another object of the present invention is to provide a Mahjong game machine in which diverse rules and options can be selected, in which levels for the cyber (computer) players can be selected diversely and freely from the first grade to the ninth grade, and in which the time required for a player to perform each play of the game can be set and controlled.

Another object of the present invention is to provide a Mahjong game machine that is easy to carry and movable.

In the preferred embodiments, a Mahjong game machine comprises a body having a main display to be placed in the middle of a Mahjong table, and four player pads to be placed on the edges of the table.

The body includes a microprocessor for executing the Mahjong game program, and a main display for displaying a series of contents associated with a progress of the game.

The player pad, which has an L-shaped section, includes a vertical portion and a horizontal portion.

The vertical portion of the player pad includes a hand display (for example, LCD) for displaying tiles in the hands of players, and a menu display section for sequentially displaying a series of corresponding acts that players should perform according to the progress of the game.

The horizontal portion includes a button section for inputting a series of corresponding acts displayed on the menu display section.

The hand display is located on the vertical portion of the L-shaped player pad so that tiles in each player's hand are not exposed to any other players.

The menu display section is located at the right side of hand display placed on the vertical portion of the L-shaped player pad to sequentially display a series of corresponding acts that players should perform according to the progress of the game.

The button section for inputting the series of corresponding acts associated with the progress of the game displayed on the menu display section is located on the horizontal portion of the L-shaped player pad.

Preferably, the Mahjong game program allows the time required for a human player to perform each act of the game to be set and controlled, thereby implementing a realistic Mahjong game.

BRIEF DESCRIPTION OF THE DRAWINGS

FIGS. 6A and 6B are flow charts illustrating a progress of the Mahjong game of the present invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
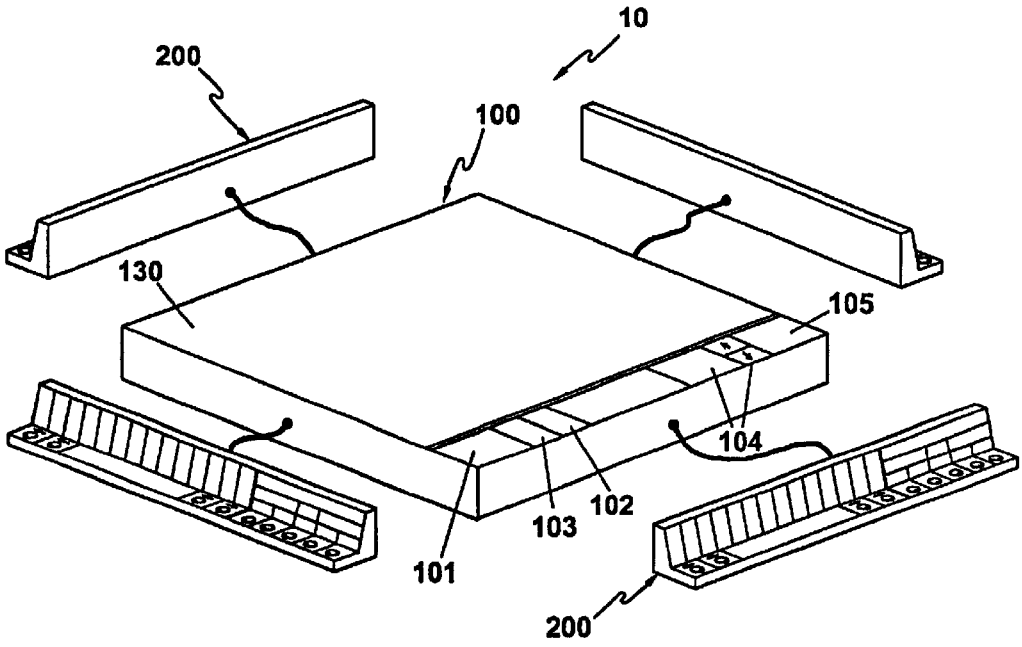
FIG. 1 is a schematic perspective view illustrating an overall appearance of a Mahjong game machine according to the present invention.

Referring to FIG. 1, the Mahjong game machine 10 of the present invention comprises a square plate shaped body 100 disposed on the top in the middle of a Mahjong table (not shown), and four player pads 200 placed in front of each player on the Mahjong table.

Figure 2:
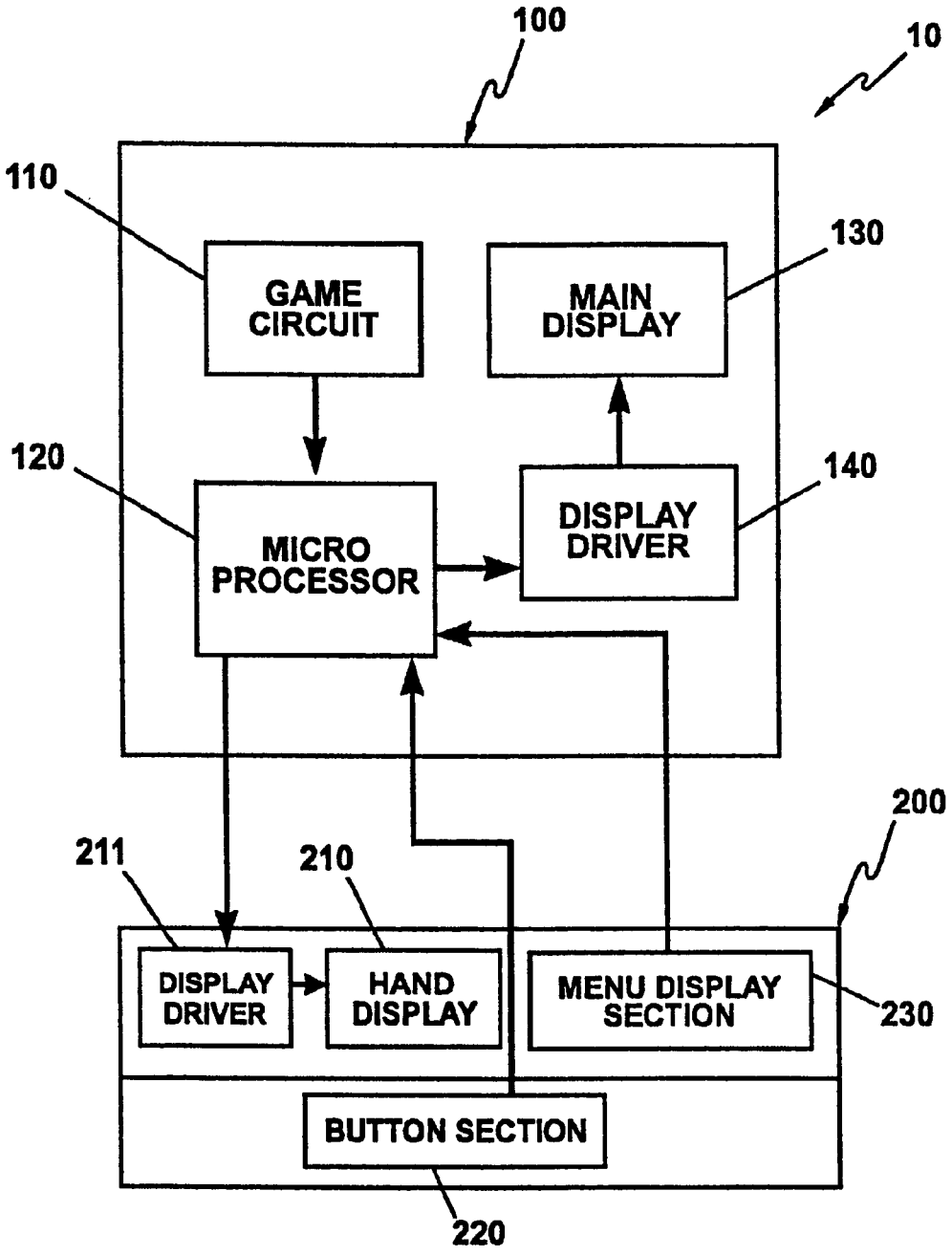
FIG. 2 is a block diagram illustrating the overall construction of the Mahjong game machine according to the present invention.

Referring to FIG. 2, the square plate shaped body 100 includes a game circuit 110 having the Mahjong program embedded therein, a microprocessor 120 for executing the Mahjong program, a main display (for example, LCD) 130 for displaying a series of contents associated with the progress of the Mahjong game, and a display driver 140.

As shown in FIG. 1, the body 100 also includes a power button 101, a game start button 102, a game end button 103, an option selecting button 104, and an enter button 105.

Preferably, the Mahjong program that is executed by the microprocessor 120 is programmed in such a manner that it sets and limits the time required for a human player to perform each play of the Mahjong game so that a pick-up act of the game is performed automatically if the time limit elapses, and a penalty to a corresponding player is charged if the time limit elapses for a post-pick-up act, and a response action is disregarded if the time limit elapses, while providing the time required for a human player for deciding whether or not to perform a response act for a tile discarded by any other player.

Accordingly, the Mahjong game machine 10 never allows the Mahjong game to be delayed, in the case where the human player delays an input of a pick-up act, an input of a post-pick-up act, or an input of response act for a discarded tile. Also, an impractical case in which not the human player, but the computer 120 determines whether or not to perform a response act for a discarded tile is completely eliminated.

The main display 130 of the body 100 displays a series of contents associated with the progress of the Mahjong game on a screen thereof. For example, the main display 130 can display an option selecting screen for selecting various options related to the Mahjong game including the rules of the Mahjong (for example, the Chinese style, the Japanese style, the Korean style, the World Mahjong Players Association style, etc.), the mode of the game (real, exercise), designation of whether players joining in the Mahjong game are human players or cyber players (the human players can be designated from one to four persons, accordingly the cyber players can be designated from three to none), levels of the cyber players (first to ninth grades), a variety of time limits such as the time limit (for example, 3 seconds) required for inputting a pick-up act of a player, the time limit (for example, 5 seconds) required for inputting a post-pick-up act, and the time limit (for example, 3 seconds) required for inputting a response act for a tile discarded by any other player, the allowable number of penalties (for example, 5 points), whether or not there are sound effects, etc. The main display 130 also, of course, can display all the tiles discarded by any other players, the remaining tiles in the wall, current scores, a seat and order of each of the players, etc., on a screen thereof.

Figure 3:
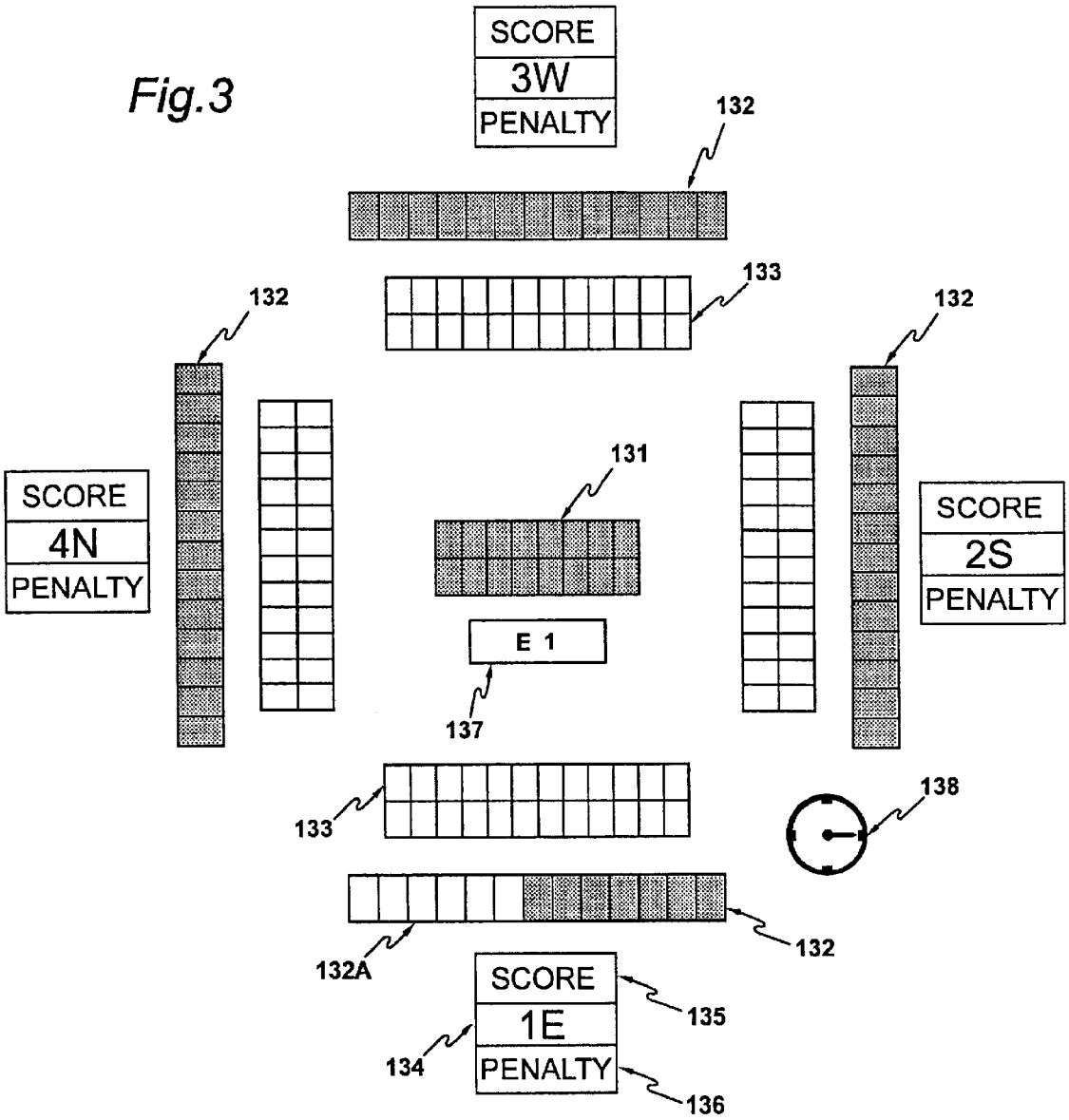
FIG. 3 is a schematic plan view illustrating a screen displayed on a main display of the Mahjong game machine according to the present invention.

FIG. 3 illustrates an example of a game progressing screen displayed on the main display of the Mahjong game machine according to the present invention.

Referring to FIG. 3, tiles 132 in the hands of players are placed face-down as concealed, and tiles 133 discarded by the players are placed face-up as exposed forming a square shape. The remaining tiles 131 in the wall are placed face-down as concealed in the middle of the screen. The names 134, the current scores 135 and the current penalties 136 of the players are displayed in front of the concealed tiles 132 in the hands. Also, a current progress information 137 is displayed in the middle portion adjacent to the remaining tiles 131 in the wall. A clock 138 monitoring the time limit required for human players to input playing acts is displayed on the right lower portion of the screen thereof.

Six exposed tiles 132A among the tiles 132 in the hand of a player, for an example, represent tiles exposed after the act of PONG, KONG, or CHEE by that player.

The player pad 200, which is electrically connected to the body 100, executes the Mahjong program embedded in the body 100. Also, the player pad 200, which basically has an L-shaped section, includes a vertical portion 201 and a horizontal portion 202.

Figure 4:
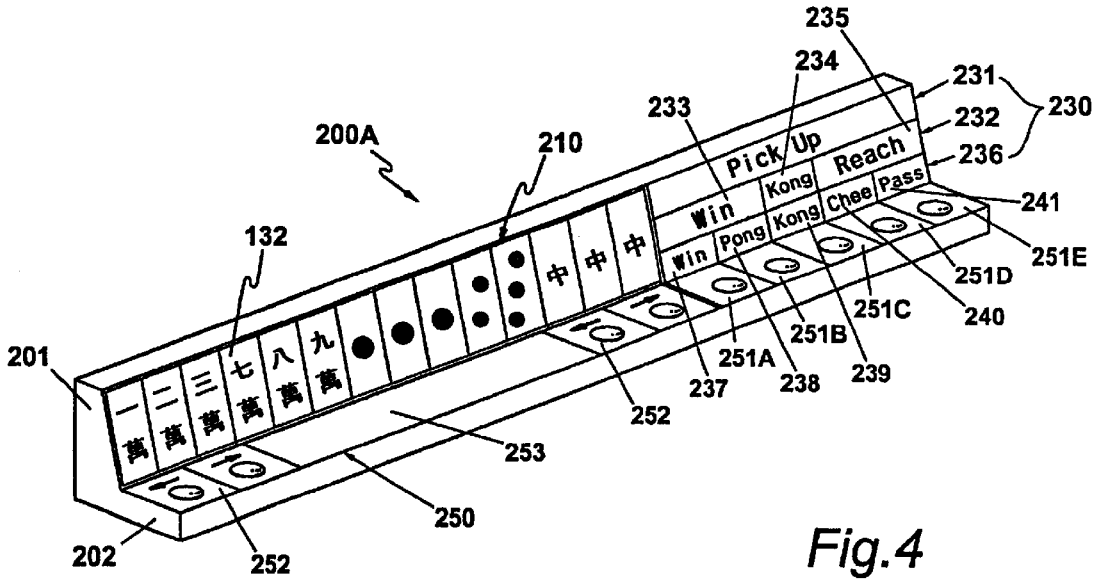
FIG. 4 is a schematic perspective view illustrating one of four player pads of the Mahjong game machine according to a preferred embodiment of the present invention.
Figure 5:
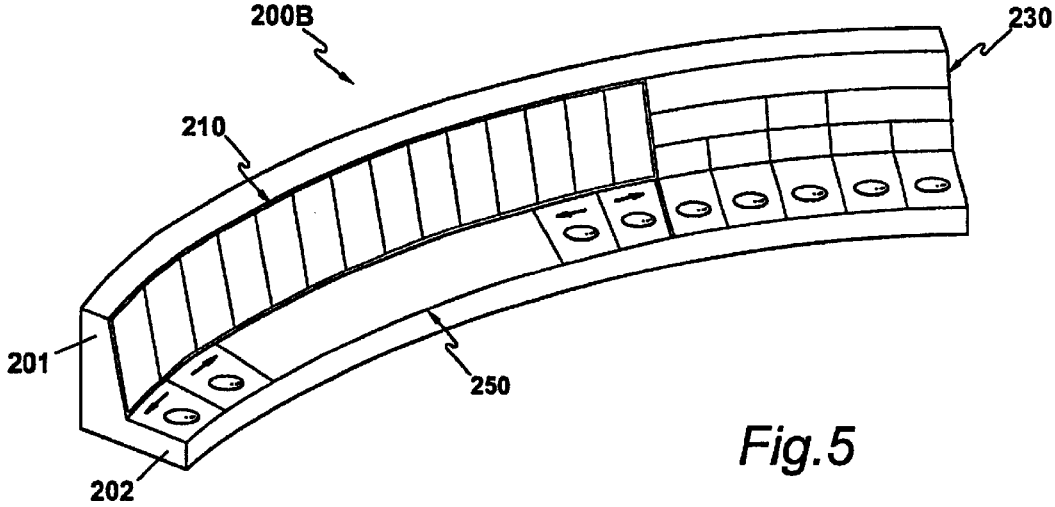
FIG. 5 is a schematic perspective view illustrating one of four player pads of the Mahjong game machine according to another preferred embodiment of the present invention.

FIG. 4 is a schematic perspective view illustrating a linear player pad of the Mahjong game machine according to a preferred embodiment of the present invention, and FIG. 5 is a schematic perspective view illustrating a round player pad of the Mahjong game machine according to another preferred embodiment of the present invention.

As shown in FIGS. 2, 4 and 5, the vertical portion 201 of the player pad 200 includes a hand display 210 (for example, LCD) for displaying tiles in the hands of players, and a menu display section 230 for sequentially displaying a series of corresponding acts that players should perform according to the progress of the game of Mahjong.

The horizontal portion 202 of the player pad 200 includes a button section 250 for inputting the series of the corresponding acts displayed on the menu display section 230.

Although only one player pad 200 has been shown for simplicity of expression in FIG. 2, the three remaining player pads not shown are also, of course, electrically connected to the body 100. The reference number 211 of the FIG. 2 denotes a display driver for driving the hand display 210.

The hand display 210 is mounted on the internal surface of the vertical portion 201 of the L-shaped player pad 200, preferably, at the left portion of the internal surface thereof so that tiles displayed on the hand display 210 are not exposed to any other players. The hand display 210 displays a maximum of 14 tiles in a corresponding player's hand from the left to the right sequentially on the internal surface thereof.

As shown in FIGS. 4 and 5, the menu display section 230 is mounted on the internal surface of the vertical portion 201 of the L-shaped player pad 200, preferably, at the right portion of the internal surface thereof for sequentially displaying a menu of corresponding acts that players should perform according to the progress of the game of Mahjong.

More particularly, a pick-up menu 231 for prompting a pick-up act is mounted at the upper portion of the menu display section 230, a post-pick-up menu 232 or displaying a series of acts to be performed after the pick-up of a tile, such as WIN 233, KONG 234, and REACH 235 is mounted in the middle portion thereof, and a response menu 236 for displaying a series of acts to be performed after a tile is discarded by any other player, such as WIN 237, PONG 238, KONG 239, CHEE 240, and PASS 241 is mounted at the lower portion thereof.

The menu display section 230 is constructed in such a manner that the pick-up menu 231, the post-pick-up menu 232, and the response menu 236 are lighted up in order, as the act (ACT A) of picking up tiles from the remaining tiles 131 in the wall, the act (ACT B) of declaring WIN, KONG, or REACH after the pick-up of a tile, and the act (ACT C) of declaring WIN, PONG, KONG, CHEE, or PASS for a tile discarded by any other player progress sequentially.

The button section 250 for inputting a series of acts corresponding to the menu display section 230 is disposed on the horizontal portion 202 of the L-shaped player pad 200 so that the buttons can be smoothly manipulated. Preferably, the button section 250 includes pick-up buttons 251A–251E for inputting a pick-up or an act of drawing a tile from the wall, cursor-moving buttons 252 for selecting a tile to be discarded after pick-up of a tile, or declaring PONG or CHEE, an enter button 253 for inputting the discard act of the selected tiles, a plurality of post-pick-up buttons 251A–251E for inputting WIN, KONG, or REACH after the pick-up of a tile, and a plurality of response buttons 251A–251E for inputting WIN, PONG, KONG, CHEE, or PASS for a tile discarded by any other player.

Preferably, when any one tile is selected on the hand display 230 by manipulation of the cursor-moving buttons 252, the selected tile 132 is lighted up so that it can be distinguished from other tiles not selected. As a result, it will help prevent a player from making a mistake in the selection and discard of a tile.

The reason why the pick-up buttons, a group of post-pick-up buttons, and a group of response buttons are all the same parts, and the identical reference numbers 251A–251E are annexed to these parts will be explained hereinafter.

Preferably, although the arrangement of the buttons of the button section 250 is not specially limited, the enter button 253 is placed at a larger area on the left side of the horizontal portion 201 of the player pad 200 and the two cursor-moving buttons 252 are placed on the left and right sides of the enter button 253, respectively, while placing the group of buttons including the pick-up buttons, the post-pick-up buttons, and the response buttons on the right side of the horizontal portion 201 so that players can manipulate the buttons conveniently.

The input of the act (ACT A) of picking up a tile from the wall 131, the act (ACT B) of declaring WIN, KONG, or REACH after the pick-up of the a tile, and the act (ACT C) of declaring WIN, PONG, KONG, CHEE, or PASS for a tile discarded by any other player requires a total of nine buttons. However, in the Mahjong game, the ACTs A, B and C are not performed simultaneously, but are performed mutual-exclusively, so that all these acts can inputted with only five buttons 251A–251E.

The five buttons 251A–251E can be mounted in a row on the right side of the horizontal portion 202 corresponding to five actions of WIN 237, PONG 238, KONG 239, CHEE 240, and PASS 241, respectively.

Further, the circuits of the button section 250 and the menu display 230 are properly constructed in such a manner that when players perform the ACT A, the pick-up menu 231 is lighted up and all the five buttons 251A–251E function as the pick-up buttons for inputting the pick-up act; when players perform the ACT B, the post-pick-up menu 232 is lighted up, and two buttons 251A and 251B placed at the left side function as the buttons for inputting WIN 233, one button 251C placed in the center function as the button for inputting KONG 234, and two buttons 251D and 251E placed at the right side function as the buttons for inputting REACH 235, respectively; when players perform the ACT C, the response menu 236 is lighted up, and the five buttons 251A–251E function as the buttons for inputting WIN 237, PONG 238, KONG 239, CHEE 240, and PASS 241 in order, respectively.

In the progress of a game, first, the pick-up menu 231 of the player pad 200 allotted to a player of his/her turn to pick up a tile is lighted up to urge the player to pick up a tile, and then, when the player depresses any one of the five buttons 251A–251E to pick up a tile from the wall 131, the picked-up tile is displayed on the hand display 210 while extinguishing the pick-up menu 231 and, at the same time, lighting up the post-pick-up menu 232 to urge the player to perform the ACT B of declaring WIN, KONG, or REACH or discarding a tile after the pick-up of the tile. At this point, if the player does not depress any one of the pick-up buttons 251A–251E within the time limit (for example, three seconds) after the pick-up menu 231 has been lighted up, a tile is automatically drawn from the wall 131, so that the delay of the pick-up act can be prevented.

Then the pick-up player depresses any one of the buttons 251A–251E corresponding to WIN 233, KONG 234, and REACH 235 of the post-pick-up menu 232 or manipulates the cursor-moving button 252 to select a tile to be discarded and depresses the enter button 253 to discard the selected tile.

If the pick-up player depresses any one of the buttons 251A and 251B for inputting WIN 233, the microprocessor 120 of the body 100 assesses whether or not the inputted WIN is valid. If it is assessed as being valid, all the tiles in his/her hand are exposed to other players on the main display 130 showing the result of calculating scores thereof. On the other hand, if it is assessed as being invalid, corresponding penalty point (for example, ten points) is charged to the pick-up player. If the WIN is valid, upon confirmation of the calculated scores, settlement of the scores between players is completed while finishing the round, and then, newly distributed tiles are displayed on the main display 130 and the hand display 210 while starting another new round.

If the pick-up player depresses the button 251C for inputting KONG 234, corresponding tiles are drawn from the hand display 210 and are displayed as the exposed tiles 132A on the main display 130. Then, a tile is picked up from the end of the wall 131 to display it on the hand display 210, and the post-pick-up menu display section 232 is again lighted up to urge the pick-up player to perform the act B.

If the pick-up player depresses any one of the buttons 251D and 251E for inputting REACH 235 and selects a tile to discard after REACH, the selected tile is discarded and displayed laid down laterally on the main display 130.

In the ACT B, when the pick-up player discards one of the tiles 132 in his/her hand, the post-pick-up menu 232 of the pick-up player is extinguished while lighting up the response menu 236 for each of the other players to prompt them to perform the ACT C. Accordingly, the other players can depress the buttons 251A–251E corresponding to WIN 237, PONG 238, KONG 239, CHEE 240, and PASS 241 for the tile discarded by the pick-up player to input the corresponding acts, respectively.

If the pick-up player does not input WIN, KONG, REACH, or discard of a selected tile within the time limit (for example, five seconds) after the post-pick-up menu 232 has been lighted up, corresponding penalty is charged to the pick-up player. From the moment that a total of accumulated penalty point exceeds the threshold number (for example, five points), the corresponding player can not input WIN 237, PONG 238, KONG 239, and CHEE 230, for a tile discarded by the other player, and can also not input WIN 233, KONG 234, and REACH 235 after picking up a tile, and can only discard a tile.

If a response player depresses the buttons 251A for inputting WIN 237, the microprocessor 120 of the body 100 assesses whether or not the inputted WIN is valid. If it is assessed as being valid, all the tiles in his/her hand are exposed to other players on the main display 130 showing the result of calculating scores thereof. On the other hand, if it is assessed as being invalid, corresponding penalty point (for example, ten points) is charged to the player. If the WIN is valid, upon confirmation of calculated scores, settlement of the scores between players is completed while finishing the round, and then, newly distributed tiles are displayed on the main display 130 and the hand display 210 while starting another new round.

If a response player depresses the button 251B or the buttons 251D for inputting PONG 238 or CHEE 240, the corresponding tiles disappear from his/her hand display 210 and appear as the exposed tiles 132A on the main display 130. Then, he/she manipulates the cursor-moving button 252 to select a tile to be discarded, and depresses the enter button 253 to input the discard act of the selected tile.

If a response player depresses the button 251C for inputting KONG 239, the corresponding tiles disappear from his/her hand display 210 and appear as the exposed tiles 132A on the main display 130. Then, a tile is picked up from the end of the wall 131 displaying it on his/her hand display 210, and the post-pick-up menu 232 is lighted up to prompt him/her to perform the ACT B.

In a case where more than two players input WIN, PONG (KONG), and CHEE simultaneously for a discarded tile, priority of the players is determined in the order of WIN, PONG (KONG), and CHEE. In a case where more than two players input WIN simultaneously, the player seated near to the right side of the player who has discarded a tile is given priority.

For a tile discarded by any player, if no one inputs WIN, PONG, KONG, or CHEE, or all three players input PASS within the time limit (for example, three seconds), the pickup menu 231 of the player of next turn (the player seated at the right side of the player who has just discarded the tile) is lighted up to prompt him/her to perform the ACT A of picking-up a tile from the wall 131.

If a player inputs PASS, it manifests the intention that he/she will not declare WIN, PONG, KONG, or CHEE himself/herself, and leads to a rapid progress of the game. Therefore, although players need not input PASS, they preferably input PASS as soon as possible in order to progress the game rapidly. In a case where four human players play the game together, the effect of reducing time may be trivial since it is not frequent that all three players input PASS within the time limit (for example, three seconds). However, in a case where one human player plays the game with three cyber players, an input of PASS by the human player enables the game be progressed considerably rapidly.

According to above, each player can perform all the actions associated with the Mahjong game by the simple operation of the cursor-moving button 252, the enter button 253, and the group of buttons 251A–251E corresponding to the series acts, i.e., the ACTs A, B, and C displayed on the menu display section 230.

In the Mahjong game machine 10 as described above, the construction of concrete circuit elements of the game circuit 110, the microprocessor 120, the main display 130, the display driver 140, and the button portion including the option selecting button 104 and the enter button 105, which constitute the body 100; the construction of concrete circuit elements of the hand display 210, the menu display section 230, and the button section 250, which constitute the player pad 200; the functional connection between the body 100 and the player pad 200; the lighting up of the main display 130 and the menu display section 230; the construction of circuit elements of the five buttons 251A–251E which enable the sequential input of the ACTs A, B, and C can be suitably implemented by the art known in the technical field of the present invention to conform to the characteristic of the present invention. Also, since the construction itself of these circuit elements is not the characteristic of the present invention, the detailed description of known functions and configurations thereof incorporated herein will be omitted.

Figure 6B:
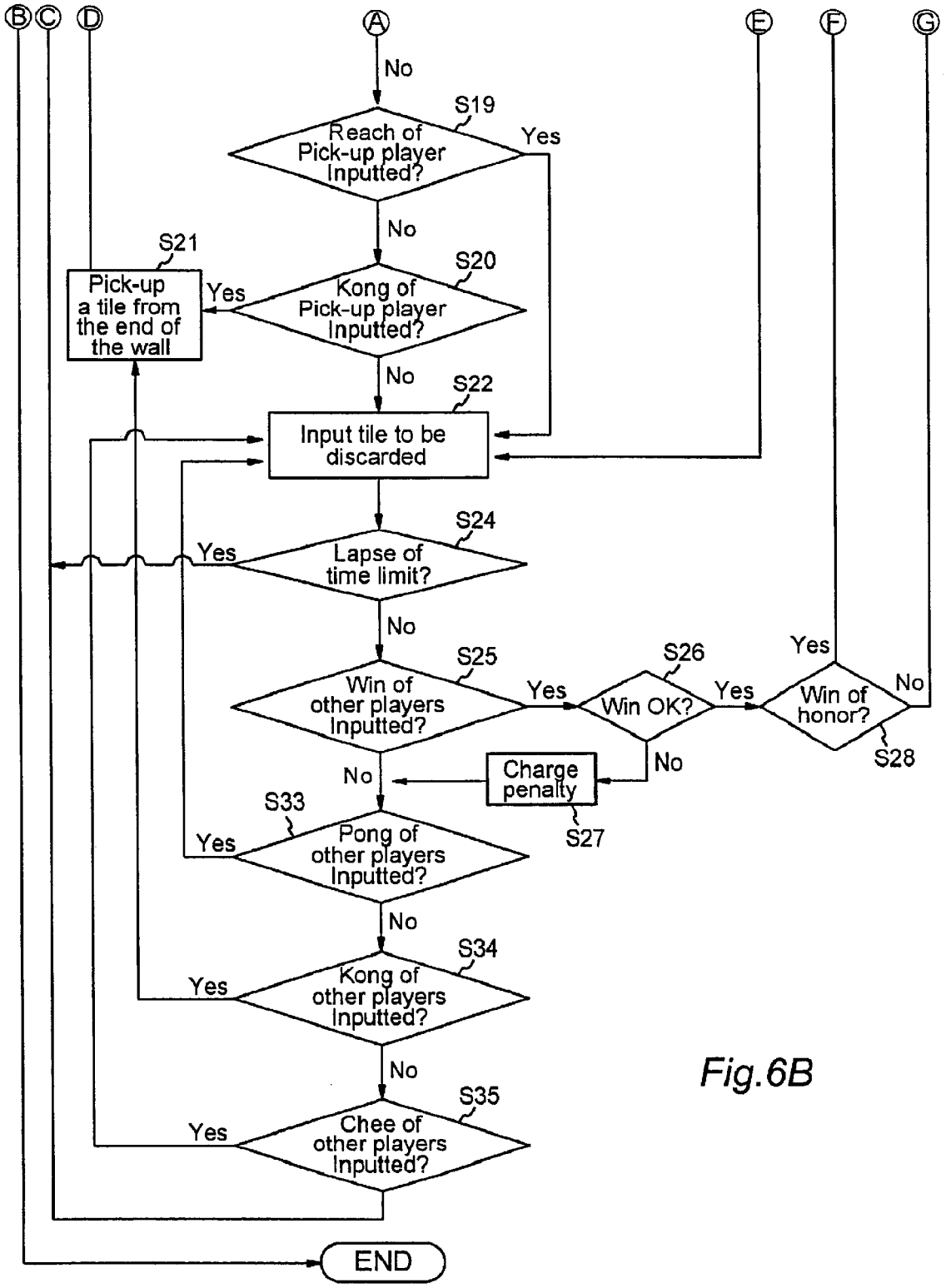

Now, an example of the procedures for a Mahjong game played by the present invention will be explained in detail hereinafter with reference to FIGS. 6A and 6B.

In the Mahjong game, each of the four players plays a round as an honor and when all four players have played as an honor, one quarter is completed. And when four quarters (East, South, West, North) have been completed, a game is finished. Therefore, a game is finished when more than 16 rounds are completed.

First, at step S1, the microprocessor 120 checks whether or not a game is finished. If the answer is YES, the game is finished. If the answer is NO, the program proceeds to step S2 in which the microprocessor 120 distributes tiles. After the tiles are distributed, or if a player's turn to pick up a tile has come, the microprocessor 120 checks whether or not the time limit (for example, three seconds) required for him/her to pick up a tile has elapsed (S3). If the pick-up act is inputted from the player pad 200 within the time limit (S4), the program proceeds to step S5 where the microprocessor checks whether or not tiles in the wall is depleted. On the other hand, if the pick-up act is not inputted from the player pad 200 within the time limit, the pick-up act is automatically inputted while checking whether or not tiles in the wall is depleted (S5). At this point, if the answer is NO, that is, it is checked that the tiles in the wall is not depleted, the pick-up of a tile is performed (S6). On the other hand, if the answer is YES, that is, it is checked that the tiles in the wall is depleted, then the round is drawn and a new round is proceeded while maintaining the honor as it is and the tiles are again distributed (S7, S8).

Next, if the microprocessor 120 checks whether or not a total of accumulated penalty points which the pick-up player has received exceeds the threshold number (for example, five points) (S9). If it is checked that the total of accumulated does not exceed the threshold number, the microprocessor 120 checks continuously whether or not the time limit (for example, five seconds) required for inputting corresponding acts (WIN, KONG, REACH or the discard of a selected tile) has elapsed (S10).

If it is checked that the time limit has not elapsed, the microprocessor 120 checks whether or not WIN is inputted from the player pad 200 of the pick-up player (S11). If it is checked that WIN is inputted from the player pad 200, the microprocessor 120 assesses whether or not the WIN is valid (S12). If it is assessed that WIN is invalid, a penalty point (for example, ten points) is charged to the pick-up player (S13), and proceeds to step S19. On the other hand, if it is assessed that WIN is valid, the microprocessor 120 checks whether or not the WIN is of the honor (S14). If it is checked that the WIN is of the honor, the corresponding round is completed and the honor is maintained as it is while distributing tiles again (Sl5, S16). On the other hand, if it is checked that the WIN is not of the honor, the corresponding round is completed and the honor is moved to the player seated right to the current honor while returning to step S1 to start a new round (Sl7, S18).

If it is checked at step S11 that the pick-up player does not input WIN, the microprocessor 120 checks whether or not the pick-up player inputs REACH (S19). If it is checked that the pick-up player does not input REACH, the microprocessor 120 checks subsequently whether or not the pick-up player inputs KONG (S20). If it is checked that the pick-up player inputs KONG, a tile is picked up from the end of the wall (S21), and the program returns to step S5. On the other hand, if it is checked that the pick-up player inputs REACH at step S19 or does not input KONG at step S20, the pick-up player inputs the discard act of a tile among the tiles in his hand by manipulating the player pad 200 (S22).

In the meantime, if it is checked at step S9 that the total of accumulated penalty points exceeds the threshold number (for example, five points), the player may not input WIN, REACH, and KONG (through S11, S19, and S20) and may input only the discard act of a tile (S22), and may also not input WIN, PONG, KONG, and CHEE for a tile discarded by any other player.

If it is checked step S10 that the time limit has elapsed, the penalty of one point is charged to a corresponding pick-up player (S23), and the microprocessor 120 checks again whether or not the total of accumulated penalty points exceeds the threshold number (S9). Then, the program proceeds to steps S10 or S22.

If a player inputs the discard act of a tile, the other three players should perform response acts (WIN, PONG, CHEE, PASS) for a tile discarded by the player within the time limit (for example, three seconds). Therefore, as soon as the step S22 has been performed, the microprocessor 120 checks whether or not the time limit required for inputting the response acts have elapsed (S24).

If it is checked at step S24 that the time limit required for inputting the response acts have not elapsed, the microprocessor 120 checks whether or not other player inputs WIN for a tile discarded by the pick-up player or a player who has just input PONG or CHEE (S25). If it is checked at step S25 that other player inputs WIN, the microprocessor 120 assesses whether or not the WIN is valid (S26). If it is assessed at step S26 that the WIN is invalid, a penalty point (for example, ten points) is charged to the player (S27) and proceeds to step S33. On the other hand, if it is assessed at step S26 that the WIN is valid, the microprocessor 120 checks whether or not the WIN is of the honor (S28). If it is checked at step S28 that the WIN is of the honor, the corresponding round is completed and the honor is maintained as it is while distributing tiles again (S29, S30). On the other hand, if it is checked that the WIN is not of the honor, the corresponding round is completed and the honor is moved to the player seated right to the current honor while returning to step S1 to start a new round (S31, S32).

Meanwhile, if it is checked at step S25 that any other player does not input WIN, the microprocessor 120 checks whether or not any other player inputs PONG (S33). If it is checked at step S33 that the other player inputs PONG, the program returns to step S22, where the player who has just input PONG discards a tile. On the other hand, if it is checked at step S33 that the other player does not input PONG, the microprocessor 120 checks whether or not the other player inputs KONG again (S34). If it is checked at step S34 that the other player inputs KONG, a tile is picked up from the end of the wall (S21) to display it on the hand display 210 of the player who has just input KONG, and then, the program returns to the step just before step S5. On the other hand, if it is checked at step S34 that the other player does not input KONG, the microprocessor 120 checks whether or not the other player inputs CHEE again (S35). If it is checked at step S35 that the other player inputs CHEE, the program returns to step S22, where the other player who has just input CHEE discards a tile. On the other hand, if it is checked at step S35 that the other player does not input CHEE, the program proceeds to step S36, where the player seated at the right side of the current pick-up player becomes the next pick-up player and the new pick-up player is prompted to pick-up a tile at step S3.

At this moment, even before the time limit (for example, three seconds) required for the response acts has elapsed, when all three players input PASS, the program goes back to step S36 to progress the game more rapidly.

In the mean time, if it is checked at step S24 that the time limit required for inputting the response acts has elapsed, the microprocessor 120 assumes that there is no intention for other players to perform the response acts for the discarded tile, and thus the player seated at the right side of the current pick-up player becomes the next pick-up player (S36) and the new pick-up player is prompted to pickup a tile at step S3.

According to the above-mentioned series of processes, human players (one to four individuals) can enjoy playing the Mahjong game with the cyber players (three to none) in substantially the same manner as a traditional Mahjong game by viewing down the main display 130 of the body 100 and operating the player pad 200 also placed on the Mahjong table. They can enjoy playing the game easily and conveniently while saving a lot of time (it is estimated that time required for finish a game is reduced by about 50%).

Further, since the hand display is disposed on the vertical portion of the L-shaped player pad, although players play the game in a state that each of the player pads are placed naturally on the table, the tiles in each player's hand are not exposed to other players. This enable players enjoy playing the Mahjong game in substantially the same manner as in the traditional Mahjong game in which each player seated at the four sides of the Mahjong table builds a set of hand in front of himself/herself.

In addition, the time required for a player to perform (input) each playing act of a game can be set and controlled freely so that the Mahjong game is progressed rhythmically and realistically while keeping an actual state of tension.

Also, the Mahjong game machine of the present invention can function not only as a game machine for amusement, but also for an actual contest compared to a conventional Mahjong game machine limited to only the use for amusements.

Further, the Mahjong game machine of the present invention allows player to enjoy playing it in the same situation as an actual game while adopting various rules and options of the Mahjong game used in the world and various levels of cyber (computer) players.

Furthermore, it is expected that the Mahjong game machine of the present invention would be adopted as the standard tool of various contests since it has some intrinsic advantages such as exactness, maintenance of fairness, prefect time management, and great saving of time, etc.

What is claimed is:

1. A Mahjong game comprising:

a body including a microprocessor for executing a Mahjong program and a main display for displaying a series of contents associated with the progress of the game; and four player pads physically separated from said body, each having an L-shaped section and each including a vertical portion and a horizontal portion, wherein said vertical portion has a hand display for displaying tiles in the hand of each player such that those tiles are not exposed to the other players, and a menu display section for sequentially displaying a menu for corresponding actions that the player should perform;

wherein the menu display section includes a pick-up menu for prompting the act of picking up a tile from the wall, a post-pick-up menu for displaying the act of declaring WIN, KONG, or REACH after the pick-up of a tile, and a response menu for displaying the act of declaring WIN, PONG, KONG, CHEE, or PASS for a tile discarded by any other player;

said button section includes a cursor-moving button, an enter button, a pick-up button, a group of post-pick-up buttons, and a group of response buttons, and said horizontal portion has a button section for inputting an action corresponding to the menu displayed on said menu display section.

2. The Mahjong game machine according to claim 1, wherein said pick-up button, said group of post-pick-up buttons, and said group of response buttons consist of five buttons, for sequentially inputting the act of picking up a tile from the remaining tiles in the wall, the act of declaring WIN, KONG, or REACH after the pick-up of a tile, and the act of declaring WIN, PONG, KONG, CHEE, or PASS for a tile discarded by any other player.

3. The Mahjong game machine according to claim 1, wherein the number of times required for inputting necessary actions are set and controlled, so that when a player does not input an action within the corresponding time limit, a penalty point is charged to the player or the action is performed automatically.

4. The Mahjong game machine according to claim 1, wherein the acts to which the time control is applied include the act of picking up a tile from the remaining tiles in the wall, the act of declaring WIN, KONG, or REACH or discarding a tile after the pick-up of a tile, and the act of declaring WIN, PONG, KONG, or CHEE for a tile discarded by any other player.

* * * * *